US009350119B2

(12) United States Patent
Ozaki et al.

(10) Patent No.: US 9,350,119 B2
(45) Date of Patent: May 24, 2016

(54) WRONG INSERTION PREVENTIVE STRUCTURE OF CONNECTOR

(71) Applicant: YAZAKI CORPORATION, Tokyo (JP)

(72) Inventors: Masahito Ozaki, Shizuoka (JP); Koji Hayashi, Kanagawa (JP); Keiji Hamada, Shizuoka (JP); Takumi Nakagishi, Shizuoka (JP); Keigo Tsubo, Shizuoka (JP); Kazuhiro Fujino, Tokyo (JP); Ryusuke Murayama, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/033,433

(22) Filed: Sep. 20, 2013

(65) Prior Publication Data

US 2014/0094052 A1 Apr. 3, 2014

Related U.S. Application Data

(63) Continuation of application No. 13/817,376, filed as application No. PCT/JP2011/069943 on Sep. 1, 2011, now abandoned.

(30) Foreign Application Priority Data

Sep. 3, 2010 (JP) ..... 2010-198298
Jul. 12, 2011 (JP) ..... 2011-154126

(51) Int. Cl.
*H01R 13/648* (2006.01)
*H01R 13/658* (2011.01)
(Continued)

(52) U.S. Cl.
CPC ..... *H01R 13/64* (2013.01); *H01R 13/641* (2013.01); *H01R 13/6456* (2013.01); *H01R 13/6582* (2013.01); *H01R 13/658* (2013.01); *H01R 13/6581* (2013.01)

(58) Field of Classification Search
CPC ..... H01R 13/64; H01R 13/6581
USPC ..... 439/676, 677, 680, 374, 607.17, 439/607.35, 607.36, 607.37, 607.38, 439/607.39, 607.4, 607.54
See application file for complete search history.

(56) References Cited

U.S. PATENT DOCUMENTS 6,322,396 B1 11/2001 Kuan
6,350,156 B1 2/2002 Hasircoglu et al.
(Continued)

FOREIGN PATENT DOCUMENTS

JP 9-171776 A 6/1997
JP 10-187896 A 7/1998
(Continued)

OTHER PUBLICATIONS

The Extended European Search Report for the related European Patent Application No. 11821939.3 dated Jan. 2, 2014.
(Continued)

*Primary Examiner* — Felix O Figueroa
*Assistant Examiner* — Paul Baillargeon
(74) *Attorney, Agent, or Firm* — Kenealy Vaidya LLP

(57) ABSTRACT

A first shielding case of a receptacle respectively has arms extending to a forward side to be forwardly folded back from proximal ends fixed to a back end of an upper surface wall, stopper walls formed on free ends of the arms and projecting from outside to inside of the first shielding case and abut on an unauthorized plug in inserting the unauthorized plug, plug pickup parts formed on the free ends of the arms and are integrally formed in parallel with the stopper walls and projecting from outside to inside of the first shielding case and abut on an authorized plug in of inserting the authorized plug, and holes formed near to an opening of the upper surface wall, the holes into which the stopper walls and the plug pickup parts are inserted, on both ends of a width direction.

9 Claims, 13 Drawing Sheets

(51) Int. Cl.

| | |
|---|---|
| ***H01R 13/6581*** | (2011.01) |
| ***H01R 13/6582*** | (2011.01) |
| ***H01R 13/64*** | (2006.01) |
| ***H01R 13/645*** | (2006.01) |
| ***H01R 13/641*** | (2006.01) |

(56) References Cited

U.S. PATENT DOCUMENTS

| | | | |
|---|---|---|---|
| 6,966,798 | B1 | 11/2005 | Wu |
| 7,114,995 | B1 | 10/2006 | Ohshima |
| 2002/0146114 | A1 | 10/2002 | Kameya et al. |
| 2004/0235358 | A1 | 11/2004 | Wan et al. |
| 2008/0194147 | A1 | 8/2008 | Wu et al. |

FOREIGN PATENT DOCUMENTS

| | | | |
|---|---|---|---|
| JP | 2002-313492 | A | 10/2002 |
| JP | 3113441 | U | 9/2005 |
| JP | 2007-149602 | A | 6/2007 |

OTHER PUBLICATIONS

International Search Report for PCT/JP2011/069943 dated Dec. 6, 2011.

Taiwanese Office Action for the related Taiwanese Patent Application No. 100131664 dated Jun. 26, 2014.

Office Action from Chinese Patent App. No. 201180042573.5 (Sep. 28, 2014) with English language translation thereof.

Japanese Office Action for the related Japanese Patent Application No. 2011-154126 dated Feb. 10, 2015.

European Office Action for the related European Patent Application No. 11 821 939.3 dated Feb. 17, 2016.

WRONG INSERTION PREVENTIVE STRUCTURE OF CONNECTOR

This application is a continuation application claiming priority under 35 U.S.C. §120 to co-pending U.S. patent application Ser. No. 13/817,376 filed on Feb. 15, 2013 which was a U.S. national phase filing under 35 U.S.C. §371 of PCT Application No. PCT/JP2011/069943, filed Sep. 1, 2011, and claims priority under 35 U.S.C. §119 to Japanese patent application numbers JP2010-198298 and JP2011-154126 filed on Sep. 3, 2010 and Jul. 12, 2011, respectively, the entireties of all of which are incorporated herein by reference.

TECHNICAL FIELD

The present invention relates to a wrong insertion preventive structure of a connector.

BACKGROUND ART

A connector having a wrong insertion preventive structure of the connector includes a connector described in the following Patent Reference 1. As shown in FIGS. 16 and 17, this connector described in Patent Reference 1 includes a receptacle 110, and an authorized plug 140 connected to the receptacle 110. The opening edge of a shielding case 116 of the receptacle 110 is provided with a wrong insertion preventive guide piece 118, and a recess 148 corresponding to the wrong insertion preventive guide piece 118 is formed in a shielding case 146 of the authorized plug 140. Then, proper connection can be obtained by inserting and fitting the wrong insertion preventive guide piece 118 into the recess 148 in the case of connecting the authorized plug 140 to the receptacle 110.

PRIOR ART REFERENCE

Patent Reference

Patent Reference 1: JP-A-2007-149602

DISCLOSURE OF THE INVENTION

Problems that the Invention is to Solve

However, in the receptacle 110 described in Patent Reference 1, an improper unauthorized plug with the shape smaller than the authorized plug 140 rather than the authorized plug 140 adapted to this receptacle 110 may be inserted into the opening of the receptacle 110, and when such an unauthorized plug is wrongly inserted into the receptacle 110, the receptacle 110 and the unauthorized plug may be damaged, or wrong connection between both of the receptacle 110 and the unauthorized plug may be made.

Hence, an object of the invention is to solve the problem described above, and is to provide a wrong insertion preventive structure of a connector, in which an unauthorized plug is prevented from being wrongly inserted into a receptacle.

Means for Solving the Problems

The object of the invention described above is achieved by the following configurations.

(1) A wrong insertion preventive structure of a connector, comprising:

a receptacle which internally receives a first connecting terminal and also has a first shielding case with substantially a rectangular tube shape in which an opening for plug insertion is formed; and a plug which internally receives a second connecting terminal and has a second shielding case with substantially a rectangular tube shape inserted into the first shielding case of the receptacle;

wherein the first connecting terminal is electrically connected to the second connecting terminal by inserting the second shielding case of the plug into the first shielding case of the receptacle from the opening;

the first shielding case of the receptacle respectively has arms extending from proximal ends fixed to a back end of an upper surface wall to a forward side, stopper walls which are formed on free ends of the arms and project from the outside of the first shielding case to the inside of the first shielding case and abut on an unauthorized plug in the case of inserting the unauthorized plug, plug pickup parts which are formed on the free ends of the arms and are integrally formed in parallel with the stopper walls and project from the outside of the first shielding case to the inside of the first shielding case and abut on an authorized plug in the case of inserting the authorized plug, and holes formed near to the opening of the upper surface wall, the holes into which the stopper walls and the plug pickup parts are inserted, on both ends of a width direction.

According to the configuration of the above (1), in the case of inserting the authorized plug, the authorized plug abuts on the plug pickup parts and is inserted and thereby, the stopper walls upwardly move inside the holes and retract from the inside of the first shielding case, so that the plug can be inserted further and the plug can properly be connected to the receptacle.

Also, in the case of inserting the unauthorized plug, the unauthorized plug cannot abut on the two plug pickup parts simultaneously and at least one stopper wall remains projecting to the inside of the first shielding case and further insertion of the unauthorized plug is inhibited, so that wrong insertion of the unauthorized plug is prevented, and damage to the plug and the receptacle and wrong connection between the plug and the receptacle can be prevented.

(2) A wrong insertion preventive structure of a connector of the above (1), wherein a support bent part capable of transmitting a locking force of the stopper wall by abutting on an edge of a hole formed in the upper surface wall is formed between a free end and a proximal end of the arm.

According to the configuration of the above (2), the support bent part is formed in the arm, so that even when the unauthorized plug is inserted and abuts on the stopper wall, the load is supported by the support bent part abutting on the edge of the hole and the load does not act over the whole length of the arm. Accordingly, buckling of the arm in the case where the load acts on the stopper wall can be prevented while increasing the arm and ensuring flexibility.

(3) A wrong insertion preventive structure of a connector of the above (1) or (2), wherein the arm formed separately from a shielding case body of the first shielding case is supported and fixed to the shielding case body.

According to the configuration of the above (3), the shielding case body of the first shielding case can be manufactured by a common metal mold. The first shielding case can cope easily with variations of the presence or absence of the arm by preparing the shielding case body including no arm and the arm attached to the shielding case body.

(4) A wrong insertion preventive structure of a connector of the above (1) to (3), wherein a free end of the arm has a lid part with which a hole formed in the upper surface wall is covered.

According to the configuration of the above (4), the hole formed in the upper surface wall is covered with the lid part formed on the free end of the arm, so that a decrease in shielding performance can be prevented.

The invention has been described above briefly. Further, the details of the invention will become more apparent by reading through a mode (hereinafter called an "embodiment") for carrying out the invention described below with reference to the accompanying drawings.

MODE FOR CARRYING OUT THE INVENTION

Figure 1:
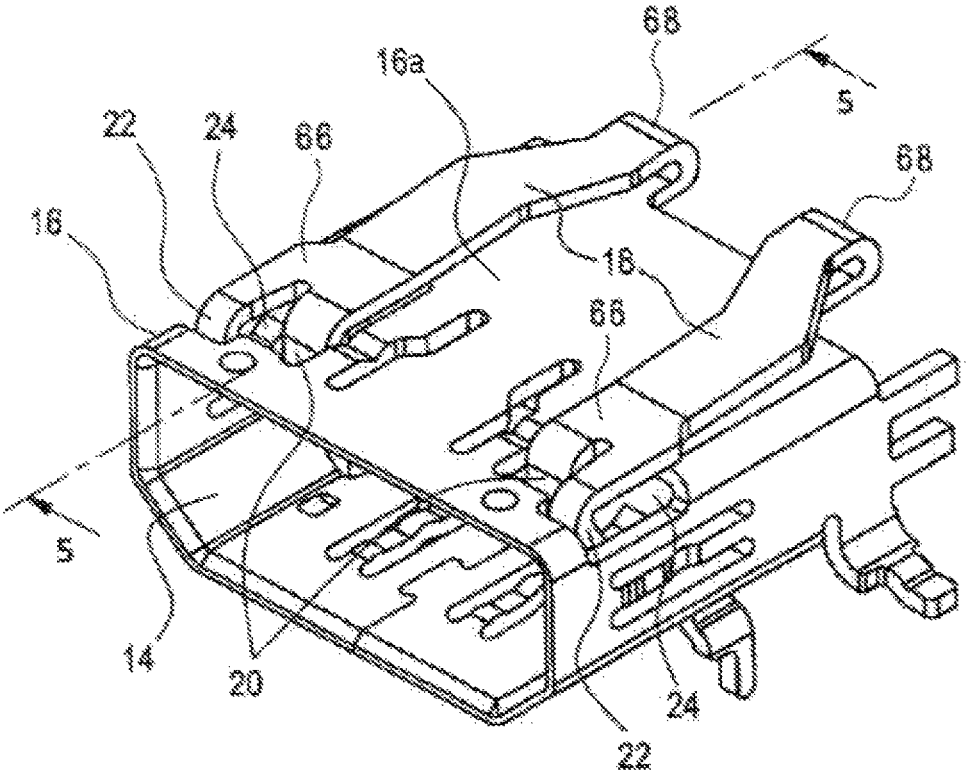
FIG. 1 is a perspective view of a receptacle according to a first embodiment of the invention.
Figure 2:
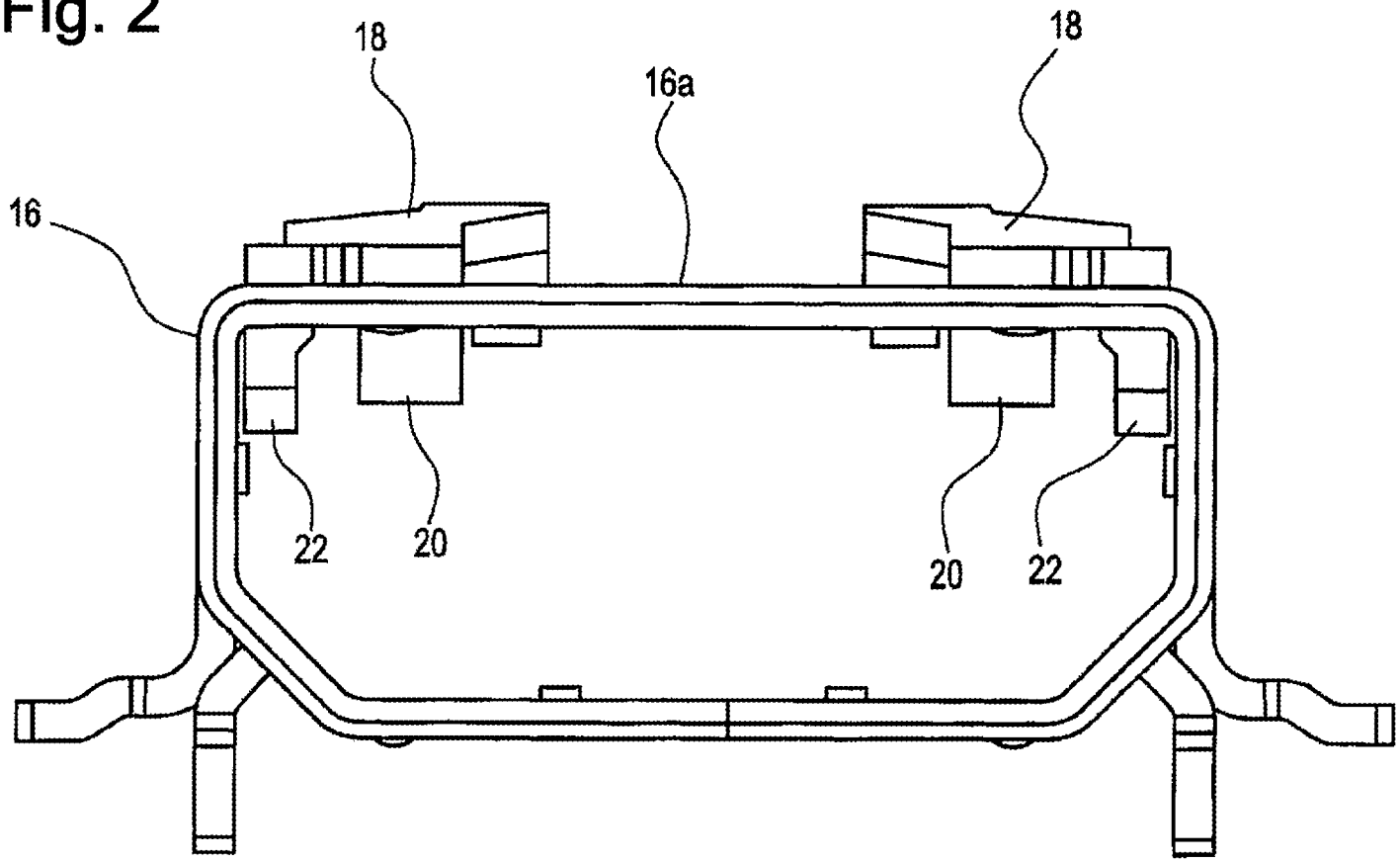
FIG. 2 is a front view from the plug insertion side of the receptacle of FIG. 1.
Figure 3:
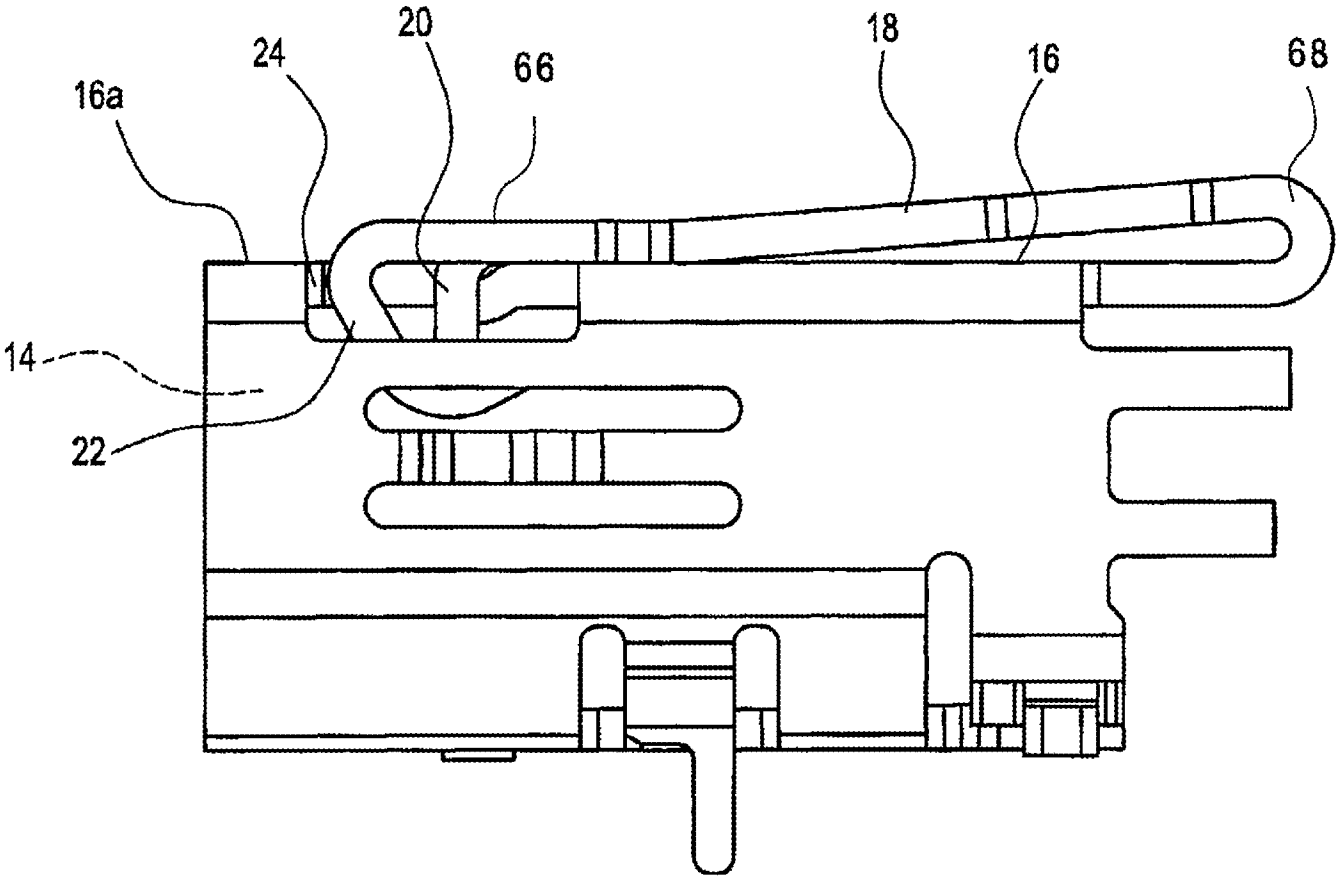
FIG. 3 is a side view of the receptacle of FIG. 1.
Figure 4:
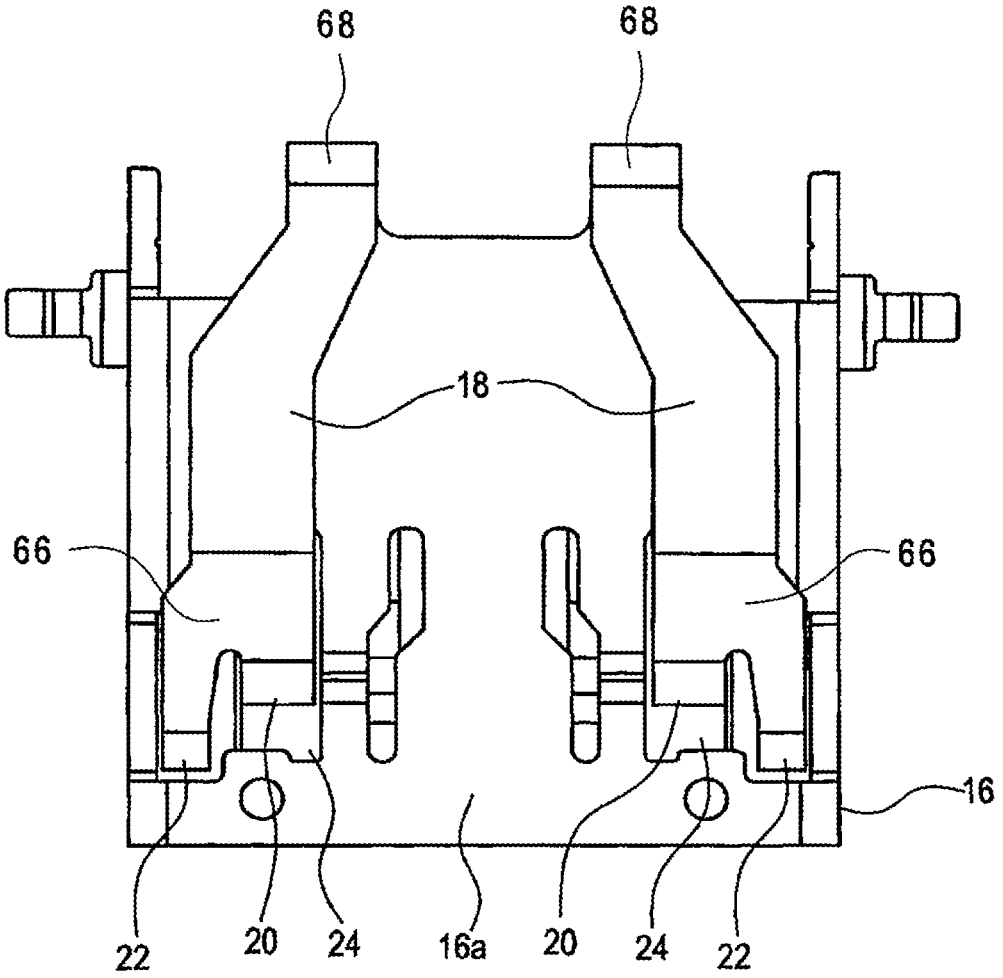
FIG. 4 is a plan view of the receptacle of FIG. 1.
Figure 5:
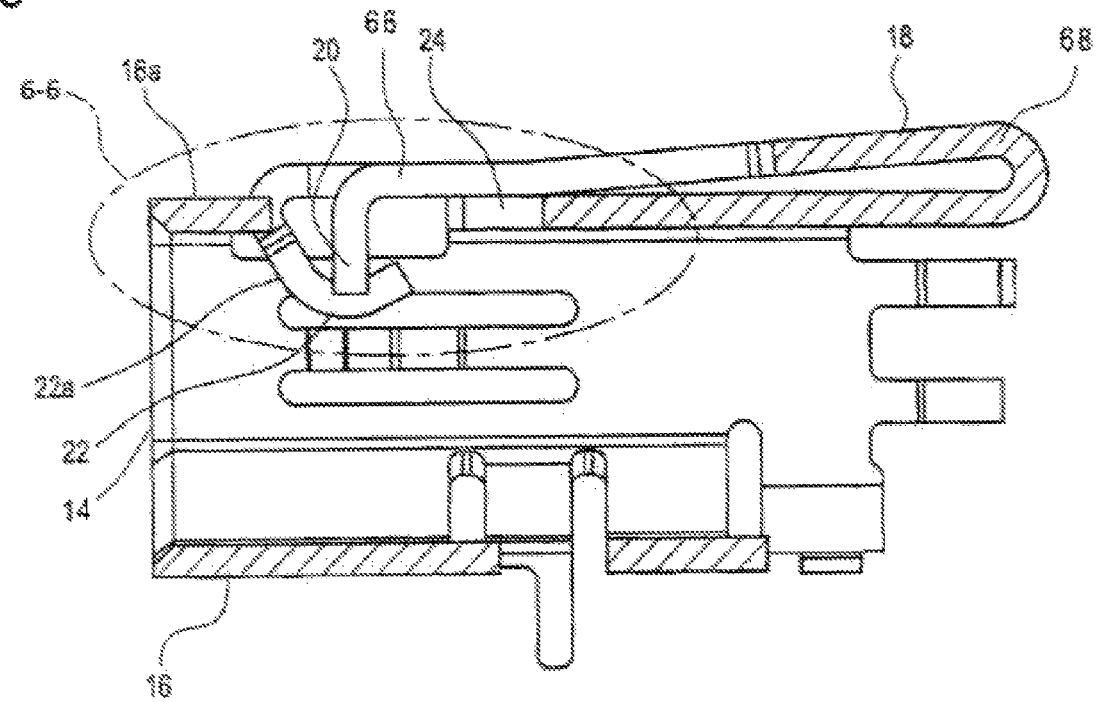
FIG. 5 is a sectional view taken on line 5-5 of the receptacle of FIG. 1.
Figure 6:
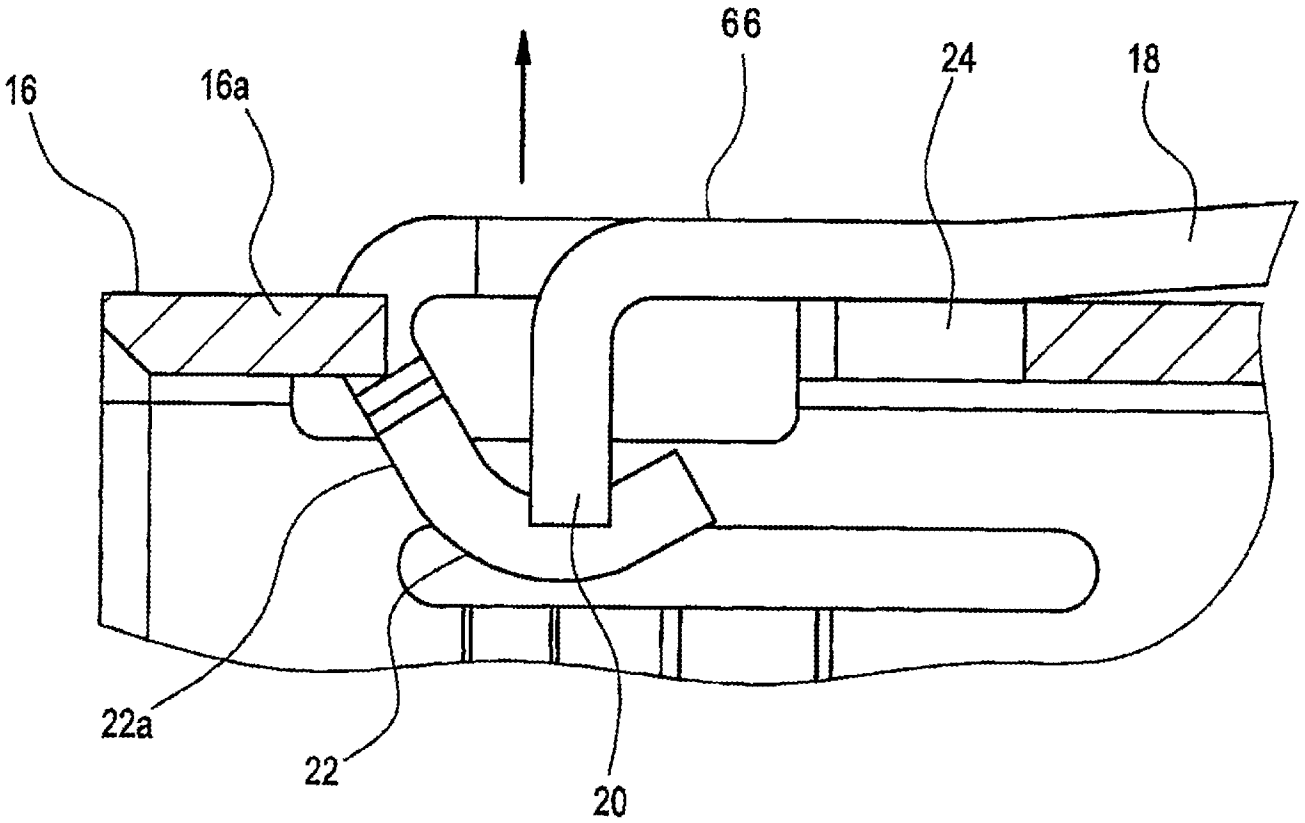
FIG. 6 is an enlarged view of part 6-6 of FIG. 5.

One embodiment of the invention will hereinafter be described with reference to the accompanying drawings.

As shown in FIGS. 1 to 11, a connector of a first embodiment includes a receptacle 10 which internally receives a first connecting terminal 12 and also has a first shielding case 16 with substantially a rectangular tube shape in which an opening 14 for plug insertion is formed, and an authorized plug 40 which internally receives a second connecting terminal 42 and has a second shielding case 46 with substantially a rectangular tube shape inserted into the first shielding case 16 of the receptacle 10, and is constructed so as to electrically connect the first connecting terminal 12 to the second connecting terminal 42 by inserting the second shielding case 46 of the authorized plug 40 into the first shielding case 16 of the receptacle 10 from the opening 14.

The first shielding case 16 of the receptacle 10 has arms 18 extending from proximal ends 68 fixed by being forwardly folded back from the back end of an upper surface wall 16*a* to the forward side on both sides of a width direction. A free end 66 of the arm 18 is provided with a stopper wall 20 which projects from the outside of the first shielding case 16 to the inside of the first shielding case 16 and abuts on an unauthorized plug 50 in the case of inserting the unauthorized plug 50 (see FIGS. 10 and 11), and a plug pickup part 22 which is integrally formed in parallel with the stopper wall 20 and projects from the outside of the first shielding case 16 to the inside of the first shielding case 16 and abuts on the authorized plug 40 in the case of inserting the authorized plug 40.

Also, holes 24 into which the stopper walls 20 and the plug pickup parts 22 are inserted are formed in both ends of the width direction near to the opening 14 of the upper surface wall 16*a* of the first shielding case 16.

The first shielding case 16 of the receptacle 10 is formed by punching a metal plate in a predetermined shape and folding the metal plate in substantially a rectangular tube shape and joining both ends by dovetail grooves. The first shielding case 16 of the receptacle 10 has the opening 14 for plug insertion in the forward side, and a housing 26 including the first connecting terminal 12 is received in the backward side (see FIGS. 8 and 9).

Each of the arms 18 extends from the backward side end of the first shielding case 16, and is folded from the proximal end 68 fixed to the back end of the upper surface wall to the forward side and is cantilevered, and is constructed so that elasticity can be generated. The stopper wall 20 extending through the upper surface wall 16*a* of the first shielding case 16 and projecting to the inside of the first shielding case 16 and the plug pickup part 22 positioned in parallel with this stopper wall 20 are integrally formed on the free end 66 of the arm 18.

The stopper wall 20 is folded and formed in a direction perpendicular to the arm 18. Also, the plug pickup part 22 has an inclined surface 22*a* descending toward the backward side, and this inclined surface 22*a* forms a plug pickup surface.

In a state in which the authorized plug 40 is not connected, the stopper wall 20 and the plug pickup part 22 extend through the hole 24 formed in the upper surface wall 16*a* of the first shielding case 16 and project to the inside of the first shielding case 16.

The plug pickup parts 22 are positioned in the outside of the width direction beyond the stopper walls 20 in both ends of the width direction inside the first shielding case 16, and are constructed so as to abut on the second connecting terminal 42 of the authorized plug 40 in the case of inserting the authorized plug 40 into the receptacle 10. The plug pickup parts 22 are positioned in the end side of the opening 14 than the stopper walls 20, and are constructed so as to abut on the second shielding case 46 of the authorized plug 40 ahead of the stopper walls 20 in the case of inserting the authorized plug 40 into the receptacle 10.

A lower surface of the receptacle 10 of the present embodiment is brought into contact with a circuit substrate and is fixed, and the first connecting terminal 12 is electrically connected to a circuit of the circuit substrate 30.

Also, the authorized plug 40 is formed on the end of an electric wire for connection to an electronic device, or is directly formed on the electronic device.

Next, work of connection between the authorized plug 40 and the receptacle 10 will be described.

When the authorized plug 40 is inserted into the opening 14 of the receptacle 10, the second shielding case 46 of the authorized plug 40 abuts on the plug pickup parts 22. When a force in an insertion direction acts on the plug pickup parts 22 as the authorized plug 40 is inserted further, the arms 18 are bent and elastically deformed so that the plug pickup parts 22 and the stopper walls 20 upwardly move inside the holes 24 and retract from the inside of the first shielding case 16 to the outside. Accordingly, the inside of the first shielding case 16 changes to a state in which the stopper walls 20 do not project, and the authorized plug 40 can be inserted further.

Figure 7:
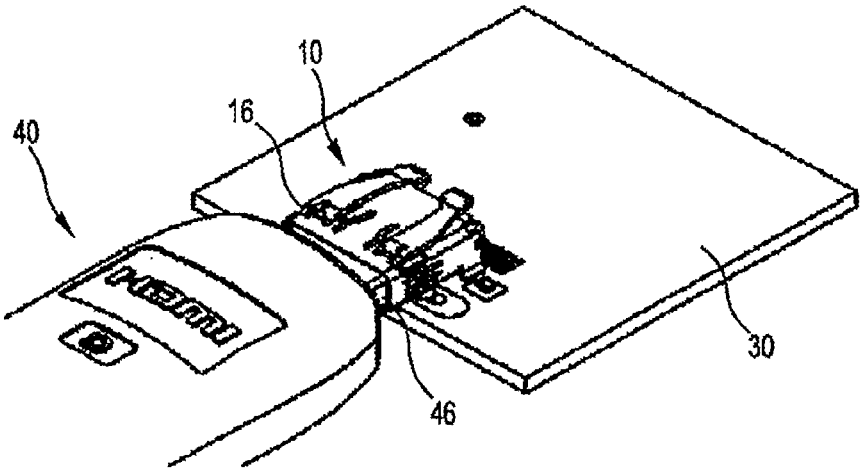
FIG. 7 is a perspective view of a state in which an authorized plug is coupled to the receptacle.
Figure 8:
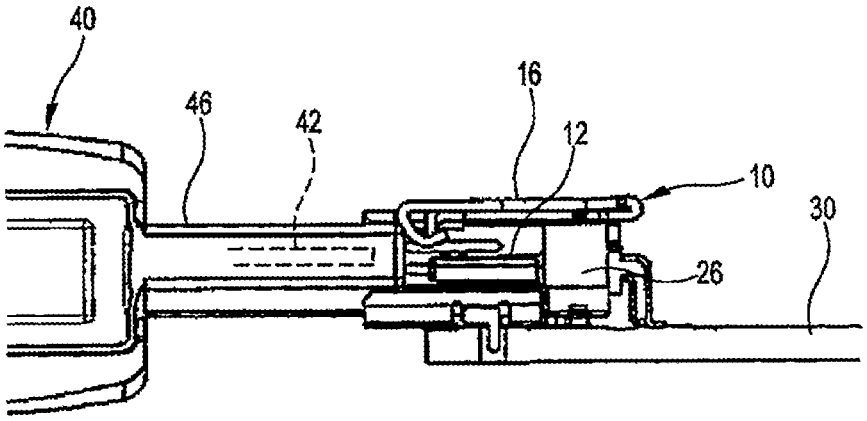
FIG. 8 is a main sectional view of a state in which the authorized plug abuts on plug pickup parts of the receptacle.
Figure 9:
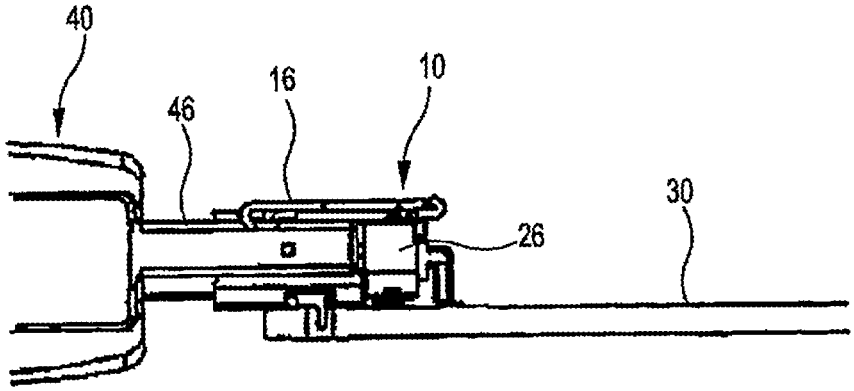
FIG. 9 is a main sectional view of a state in which the authorized plug is coupled to the receptacle.
Figure 10:
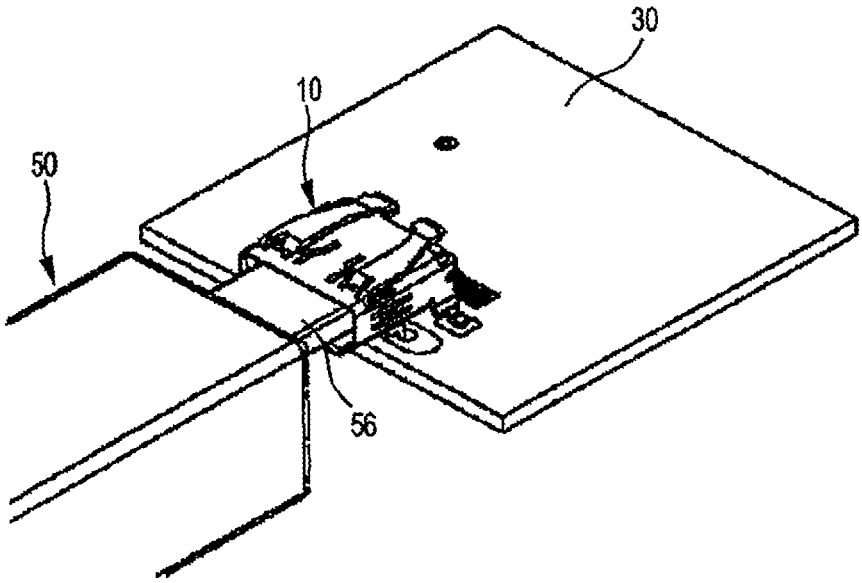
FIG. 10 is a perspective view of a state in which an unauthorized plug abuts on stopper walls of the receptacle.

Thus, the authorized plug 40 configured to abut on the two plug pickup parts 22 positioned in both sides of the opening 14 is properly inserted into the receptacle 10 to make electrical connection between both of the connecting terminals 42, 12 as shown in FIGS. 7 and 9.

In the connector of the present embodiment, for example, a plug for HDMI Type-D (also called HDMI micro) is adopted as the authorized plug 40.

On the other hand, the unauthorized plug 50 for the receptacle 10 of the present embodiment includes, for example, a small USB plug for digital camera in which a transverse width of the second shielding case 46 is shorter than that of a plug for HDMI and the transverse width of the second shielding case 46 is shorter than a distance between the plug pickup parts 22.

When such a small unauthorized plug 50 attempts to be inserted into the receptacle 10, a transverse width of a second shielding case 56 of the unauthorized plug 50 is shorter than that of the second shielding case 46 of the authorized plug 40, so that the second shielding case 56 cannot abut on both of the plug pickup parts 22 simultaneously.

Figure 11:
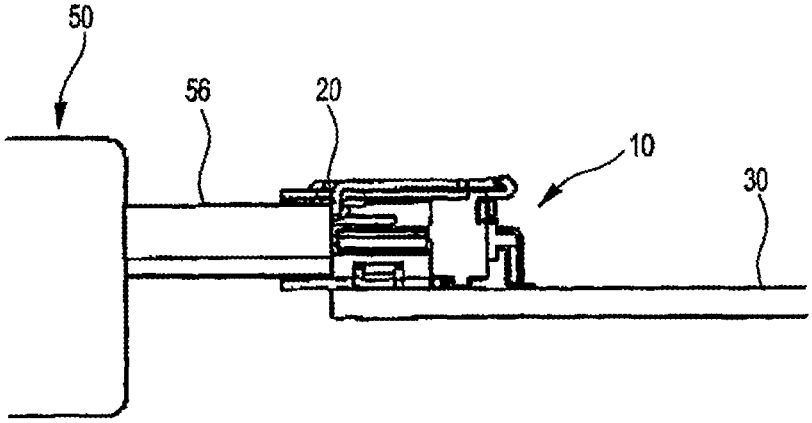
FIG. 11 is a main sectional view of a state in which the unauthorized plug abuts on the stopper walls of the receptacle.

Consequently, when the second shielding case 56 of the unauthorized plug 50 only abuts on one plug pickup part 22, one stopper wall 20 upwardly moves inside the hole 24 and only retracts to the outside of the first shielding case 16, and the other stopper wall 20 remains projecting inside the first shielding case 16. As a result, even when the unauthorized plug 50 attempts to be inserted further, as shown in FIG. 11, the first shielding case abuts on the other stopper wall 20 and further insertion is inhibited and a worker can recognize wrong insertion.

Also, when the unauthorized plug 50 is inserted in a state in which the unauthorized plug 50 does not abut on both of the plug pickup parts 22, the unauthorized plug 50 abuts directly on both of the stopper walls 20 and further insertion is inhibited.

According to the configuration of the embodiment described above thus, the improper unauthorized plug 50 is not inserted into the receptacle 10 completely, so that damage to the unauthorized plug 50 and the receptacle 10 and wrong connection between the unauthorized plug 50 and the receptacle 10 can be prevented.

Next, a second embodiment of the invention will be described.

In addition, the overlap explanation is omitted by assigning the same numerals to the same members as those of the receptacle 10 according to the first embodiment.

Figure 12:
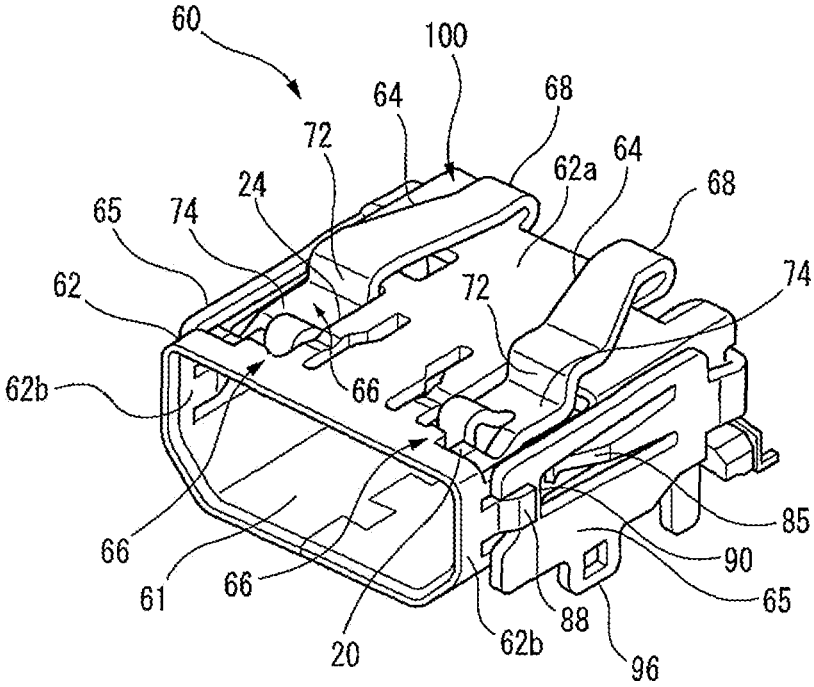
FIG. 12 is a perspective view of a receptacle according to a second embodiment of the invention.
Figure 13:
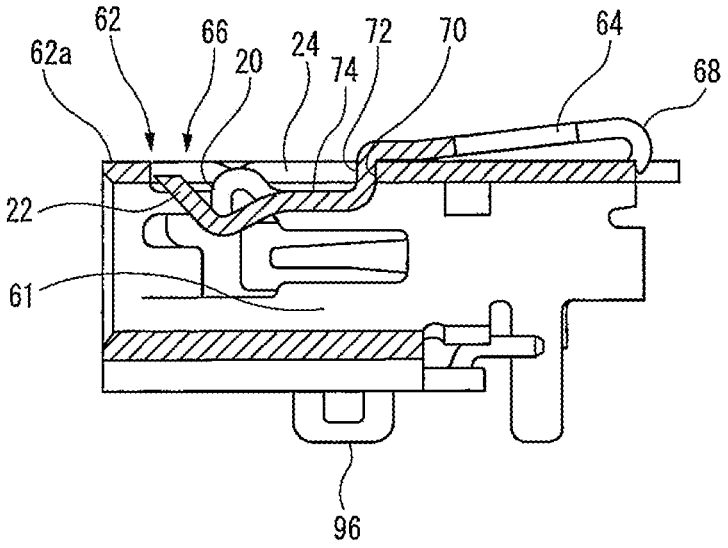
FIG. 13 is a sectional view in an arm portion of a first shielding case shown in FIG. 12.
Figure 14:
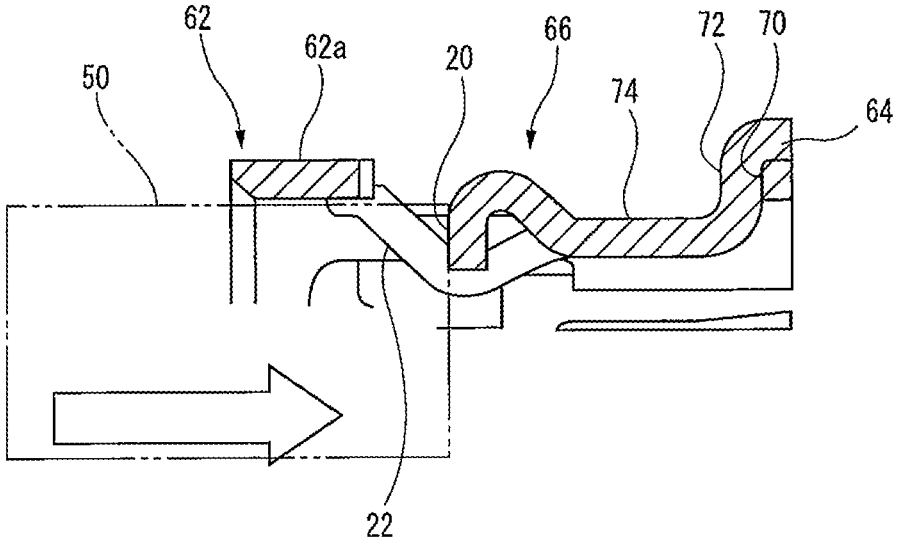
FIG. 14 is a main enlarged view of the arm portion shown in FIG. 13.

As shown in FIGS. 12 to 14, a first shielding case 62 of a receptacle 60 according to the second embodiment has arms 64 extending from proximal ends 68 fixed by being forwardly folded back from the back end of an upper surface wall 62*a* to the forward side on both sides of a width direction. A free end 66 of the arm 64 is provided with a stopper wall 20 which extends through a hole 24 of the upper surface wall 62*a* and projects to the inside (connector fitting space 61) of the first shielding case 62 and abuts on an unauthorized plug 50 in the case of inserting the unauthorized plug 50 (see FIGS. 10 and 11), and a plug pickup part 22 which is integrally formed in parallel with the stopper wall 20 and projects from the outside of the first shielding case 62 to the inside of the first shielding case 62 and abuts on an authorized plug 40 in the case of inserting the authorized plug 40.

Further, a support bent part 72 capable of transmitting a locking force of the stopper wall 20 by abutting on a hole edge 70 (see FIG. 13) in the hole 24 of the upper surface wall 62*a* is formed between the free end 66 and the proximal end 68 of the arm 64.

Also, the first shielding case 62 has side plate parts 65 forwardly folded back from the back ends of both side walls 62*b*. Elastic engaging plates 86 which extend through both side walls 62*b* and are locked in the authorized plug 40 inserted into the connector fitting space 61 are formed inside the side plate parts 65, and substrate connections 96 projecting toward a circuit substrate are vertically formed on the lower edges of the side plate parts 65. In the present embodiment, the substrate connection 96 is vertically formed on the lower edge of the side plate part 65 in a frame piece shape. The substrate connection 96 is soldered and fixed to a through hole of a circuit substrate (not shown). A locking edge 90 in which a locking claw 88 of the first shielding case 62 is locked is formed in the front of the elastic engaging plate 86 of the side plate part 65.

In the receptacle 60 of the present embodiment, when the authorized plug 40 is inserted into the connector fitting space 61, the authorized plug 40 abuts on the plug pickup parts 22 and is inserted and thereby, the stopper walls 20 upwardly move inside the holes 24 and retract from the first shielding case 62, so that the authorized plug 40 can be inserted further and the authorized plug 40 can properly be connected to the receptacle 60.

Also, as shown in FIG. 14, when the unauthorized plug 50 is inserted, the unauthorized plug 50 cannot abut on the two plug pickup parts 22 simultaneously and at least one stopper wall 20 remains projecting to the connector fitting space 61 and further insertion of the unauthorized plug 50 is inhibited, so that wrong insertion of the unauthorized plug 50 is prevented, and damage to the unauthorized plug 50 and the receptacle 60 and the wrong insertion of the unauthorized plug 50 can be prevented.

Then, since the support bent part 72 is formed in the arm 64, when the unauthorized plug 50 is inserted and abuts on the stopper wall 20, the load is supported by the support bent part 72 abutting on the hole edge 70 and the load of the unauthorized plug 50 hardly acts on the arm 64 of the back beyond the support bent part 72. That is, the load does not act over the whole length of the arm 64, so that buckling of the arm 64 in the case where the load acts on the stopper wall 20 can be prevented while increasing the arm 64 and ensuring flexibility.

Consequently, according to the wrong insertion preventive structure of the connector according to the second embodiment, wrong insertion of the unauthorized plug 50 which is not adapted to the receptacle 60 can surely be prevented and also, an insertion force of the authorized plug 40 can be decreased to improve operability.

Also, the free end 66 of the arm 64 in the receptacle 60 of the present embodiment constructs a lid part 74 with which the hole 24 formed in the upper surface wall 62*a* is covered.

By providing the arm 64 with the lid part 74, the hole 24 bored in the upper surface wall 62*a* is covered with the free end 66 of the arm 64, so that a decrease in shielding performance can be prevented.

Figure 15:
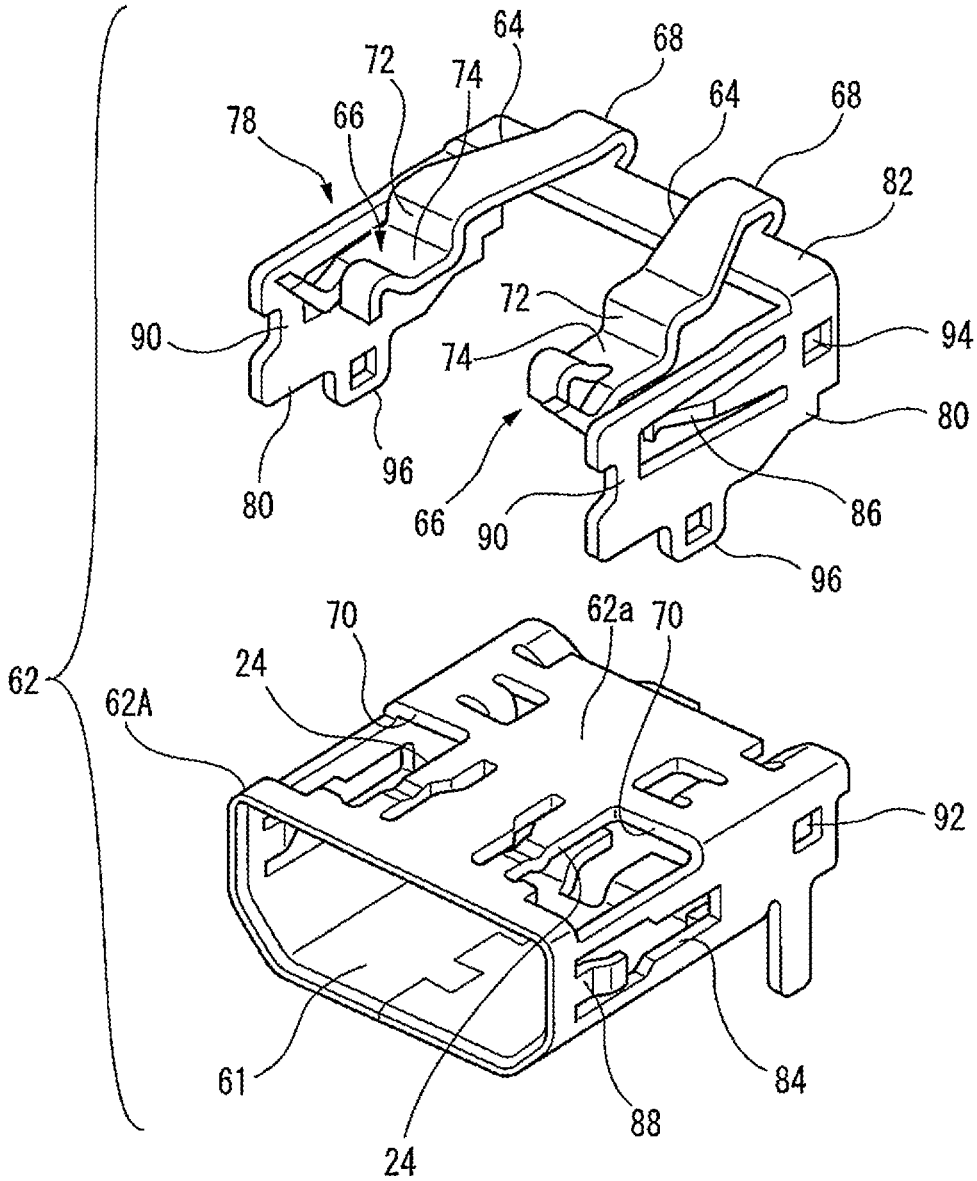
FIG. 15 is an exploded perspective view of a modified example in which arms are formed separately from a shielding case body.
Figure 16:
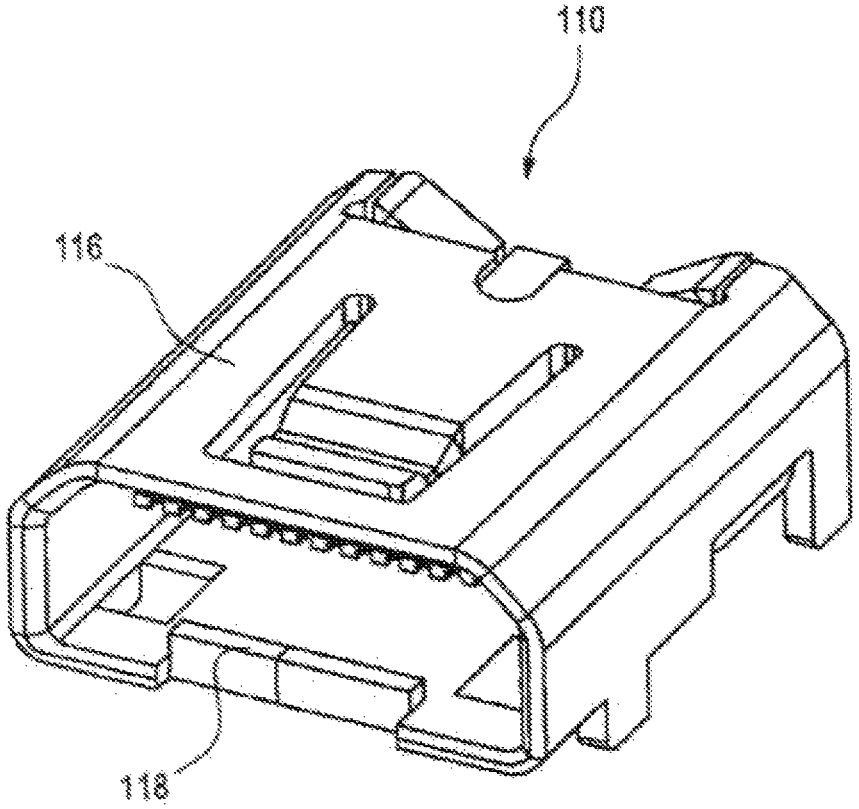
Fig. 16 RELATED ART
FIG. 16 is a perspective view of a conventional receptacle.
Figure 17:
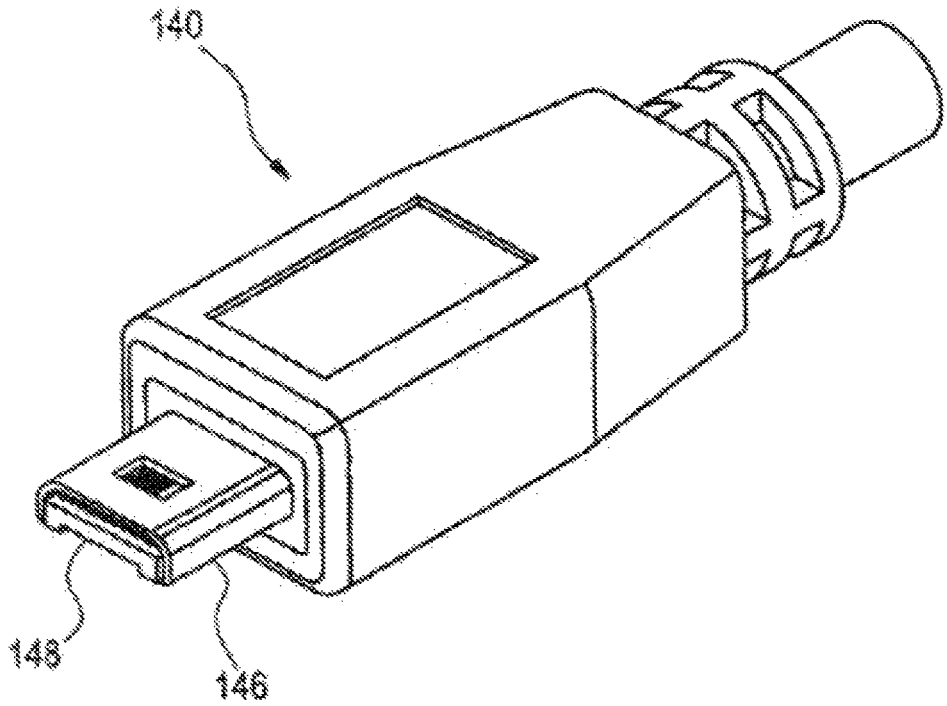
Fig. 17 RELATED ART
FIG. 17 is a perspective view of a plug coupled to the receptacle of FIG. 16.

FIG. 15 is an exploded perspective view of a modified example in which arms 64 are formed separately from a shielding case body 62A of a first shielding case 62.

In the first shielding case 62 shown in FIG. 15, the arms 64 formed separately from the shielding case body 62A are supported and fixed to the shielding case body 62A. In this case, the arms 64 are formed on an engaging support member 78. The engaging support member 78 is made by sheet-metal processing of a conductive material. The engaging support member 78 is formed in substantially a U shape in plan view in which a pair of parallel support member side plate parts 80 is joined to both ends of a back joining plate 82. The arms 64 are formed on this back joining plate 82.

In the support member side plate part 80, an elastic engaging plate 86 which extends through a locking hole 84 of the shielding case body 62A and is locked in an authorized plug 40 inserted into a connector fitting space 61 is formed inside the support member side plate part 80 punched in a U shape. A locking edge 90 in which a locking claw 88 of the shielding case body 62A is locked is formed in the front of the elastic engaging plate 86 of the support member side plate part 80. A locking convex part 94 for engaging with a locking concave part 92 of the shielding case body 62A is formed on the side (back end side) opposite to the locking edge 90 with the elastic engaging plate 86 sandwiched. The locking convex part 94 is formed in a convex shape by embossing, and is locked in the locking concave part 92 punched or in a concave shape.

Also, a substrate connection 96 projecting toward a circuit substrate is vertically formed on the support member side plate part 80. In the present embodiment, the substrate connection 96 is vertically formed on the lower edge of the support member side plate part 80 in a frame piece shape. The substrate connection 96 is soldered and fixed to a through hole of a circuit substrate (not shown).

In a connector of, for example, a digital camera, it may be wrongly fitted into a multi-USB, so that it is necessary to provide a wrong insertion preventive structure for preventing its wrong fitting. On the other hand, in a connector of, for example, a mobile telephone, a situation that is wrongly fitted into the multi-USB does not occur, so that it is unnecessary to provide an arm for wrong insertion prevention. When the structure requiring the arm and the structure requiring no arm are mixed thus, a shielding case body including the arm and a shielding case body including no arm must be manufactured separately in the first shielding case.

On the other hand, according to the configuration in which the engaging support member 78 separate from the shielding case body 62A is provided with the arms 64 as described in the present embodiment, it becomes easy to cope with variations of the presence or absence of the arm 64 by preparing the shielding case body 62A including no arm 64 and the engaging support member 78 attached to the shielding case body 62A. The shielding case body 62A can be manufactured by a common metal mold, and an increase in the manufacturing cost can be reduced.

In addition, the invention is not limited to the embodiments described above, and modifications, improvements, etc. can be made properly. Moreover, as long as the invention can be achieved, materials, shapes, dimensions, the number of components, arrangement places, etc. of each component in the embodiments described above are freely selected and are not limited.

In addition, the present application is based on Japanese patent application (patent application No. 2010-198298) filed on Sep. 3, 2010, and Japanese patent application (patent application No. 2011-154126) filed on Jul. 12, 2011, and the contents of the patent application are hereby incorporated by reference.

INDUSTRIAL APPLICABILITY

According to a wrong insertion preventive structure of a connector according to the invention as described above, wrong insertion of an unauthorized plug which is not adapted to a receptacle can surely be prevented, and damage to a plug and the receptacle and wrong connection between the plug and the receptacle can be prevented.

DESCRIPTION OF REFERENCE NUMERALS AND SIGNS

10 RECEPTACLE
12 FIRST CONNECTING TERMINAL
14 OPENING
16 FIRST SHIELDING CASE
16*a* UPPER SURFACE WALL
18 ARM
20 STOPPER WALL
22 PLUG PICKUP PART
22*a* INCLINED SURFACE
24 HOLE
26 HOUSING
40 AUTHORIZED PLUG
40 SECOND CONNECTING TERMINAL
46,56 SECOND SHIELDING CASE
50 UNAUTHORIZED PLUG
66 FREE END
68 PROXIMAL END

What is claimed is:

1. A wrong insertion preventive structure of a connector, comprising:

a receptacle which internally receives a first connecting terminal and also has a first shielding case with substantially a rectangular tube shape in which an opening for plug insertion is formed, the receptacle defining a longitudinal direction; and a plug which internally receives a second connecting terminal and has a second shielding case with substantially a rectangular tube shape inserted into the first shielding case of the receptacle in the longitudinal direction of the receptacle;

wherein the first connecting terminal is electrically connected to the second connecting terminal by inserting the second shielding case of the plug into the first shielding case of the receptacle from the opening;

the first shielding case of the receptacle is formed entirely from a metal plate by punching and folding the metal plate into a rectangular tube shape and respectively has arms being folded and cantilevered so as to extend from proximal ends fixed to a back end of an upper surface wall to a forward side, stopper walls which are formed on free ends of the arms and project from the outside of the first shielding case to the inside of the first shielding case and abut on an unauthorized plug in the case of inserting the unauthorized plug, plug pickup parts which are formed on the free ends of the arms and are integrally formed in parallel with the stopper walls and project from the outside of the first shielding case to the inside of the first shielding case and abut on an authorized plug in the case of inserting the authorized plug, and holes formed near to the opening of the upper surface wall, the holes into which the stopper walls and the plug pickup parts are inserted, on both ends of a width direction, the plug pickup parts extending through the upper surface wall via the holes at positions that are spaced longitudinally forward of positions at which the stopper walls are inserted through the upper surface wall via the holes, the plug pickup parts defining a curved member disposed within the receptacle and extending longitudinally rearwardly and terminating at positions that are longitudinally rearward of the stopper walls.

2. The wrong insertion preventive structure of a connector according to claim 1, wherein a support bent part capable of transmitting a locking force of the stopper wall by abutting on an edge of a hole formed in the upper surface wall is formed between a free end and a proximal end of the arm.

3. The wrong insertion preventive structure of a connector according to claim 1, wherein the arm formed separately from a shielding case body of the first shielding case is supported and fixed to the shielding case body.

4. The wrong insertion preventive structure of a connector according to claim 1, wherein a free end of the arm has a lid part with which one of the holes formed in the upper surface wall is covered.

5. The wrong insertion preventive structure of a connector according to claim 3, wherein a free end of the arm has a lid part with which one of the holes formed in the upper surface wall is covered.

6. The wrong insertion preventive structure of a connector according to claim 1, wherein the stopper walls extend vertically into the receptacle from the upper surface wall via the holes to a distance that is less than a vertical distance to which the plug pickup parts extend.

7. The wrong insertion preventive structure of a connector according to claim 1, wherein each plug pickup part is laterally separated from a closest one of the stopper walls by a gap.

8. The wrong insertion preventive structure of a connector according to claim 7, wherein each gap laterally separating each plug pickup part from a closest one of the stopper walls is substantially similar in length to a lateral width of each plug pickup part.

9. The wrong insertion preventive structure of a connector according to claim 1, wherein each stopper wall is laterally wider than each plug pickup part.

* * * * *